US007693434B2

(12) United States Patent
Wakamatsu

(10) Patent No.: US 7,693,434 B2
(45) Date of Patent: Apr. 6, 2010

(54) IMAGE FORMING METHOD AND APPARATUS WITH RENEWAL OF TONER RESIDUAL AMOUNT

(75) Inventor: Masaaki Wakamatsu, Chigasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/331,099

(22) Filed: Dec. 9, 2008

(65) Prior Publication Data

US 2009/0080912 A1 Mar. 26, 2009

Related U.S. Application Data

(63) Continuation of application No. 11/277,132, filed on Mar. 21, 2006, now Pat. No. 7,466,932.

(51) Int. Cl.
*G03G 15/08* (2006.01)

(52) U.S. Cl. ..... 399/27

(58) Field of Classification Search ..... 399/12, 399/27, 29, 30, 51, 61; 347/7, 86; 358/296, 358/300

See application file for complete search history.

(56) References Cited

U.S. PATENT DOCUMENTS 5,253,020 A * 10/1993 Matsushita et al. ..... 399/30
5,790,917 A * 8/1998 Takura et al. ..... 399/27
6,587,651 B2 * 7/2003 Sadowara et al. ..... 399/27
7,001,006 B2 * 2/2006 Kanamaru ..... 347/7
7,068,955 B2 * 6/2006 Yamamoto et al. ..... 399/27
7,466,932 B2 * 12/2008 Wakamatsu ..... 399/27

FOREIGN PATENT DOCUMENTS

JP 09327957 A * 12/1997
JP 2000261595 A * 9/2000
JP 2002-72812 3/2002
JP 2003-191583 7/2003
JP 2004-74464 3/2004

* cited by examiner

*Primary Examiner*—Robert Beatty
(74) *Attorney, Agent, or Firm*—SoCal IP Law Group LLP; Steven C. Sereboff; John E. Gunther

(57) ABSTRACT

When copying control (copying/printing job) is finished, the main CPU checks whether the scanner control is being executed in the scanner portion. If the scanner control is not being executed, the main CPU checks whether there is any scanner control executing request. If there is no scanner control executing request, the main CPU locks a scanner control resource, reads out a count value of a toner residual amount stored in a non-volatile RAM, renews the control information of EEPROM of the toner cartridge through an interface, releases the lock of the scanner control resource and finishes the copying operation.

17 Claims, 3 Drawing Sheets

IMAGE FORMING METHOD AND APPARATUS WITH RENEWAL OF TONER RESIDUAL AMOUNT

CROSS-REFERENCE TO RELATED APPLICATIONS

This is a continuation application of U.S. patent application Ser. No. 11/277,132 filed Mar. 21, 2006 entitled, "Image Forming Method with Renewal of Toner Residual Amount", the full contents of which are incorporated herein by reference.

BACKGROUND OF THE INVENTION

1. Field of the Invention

The present invention relates to an image forming method for use in a copying machine for supplying toner from a toner cartridge to form an image, etc.

2. Description of the Related Art

As control for detecting a toner residual amount of a toner cartridge mounted in a copying machine has been hitherto executed such control that EEPROM is mounted at the toner cartridge side, information at the toner cartridge side is read into the copying machine side when powered on, and the numerical value of the amount of toner consumed through a copying/printing job is renewed at needed time and written into EEPROM.

When data are written in EEPROM according to a serial interface style by a copying machine, it is preferable that no resource should be released to other processing from the start of the writing till the end of the writing (preventing occurrence of erroneous data writing). Therefore, the writing executing timing is set so that the writing is executed under the state that the copying machine cannot operate (24V down, jam or the like), and thus information stored in EEPROM of the toner cartridge is not necessarily kept to the latest state.

BRIEF SUMMARY OF THE INVENTION

The object of an aspect of the present invention is to provide an image forming method that can prevent occurrence of erroneous data writing and also store the latest information of a toner residual amount in EEPROM of a cartridge.

According to an aspect of the present invention, there is provided an image forming method for an image forming device having reading means for reading an image of an original, and image forming means for supplying toner from a toner cartridge in which storage means for storing toner residual amount information is mounted, thereby forming an image, comprising: storing the toner residual amount information of the toner cartridge when control of forming an image by the image forming means is finished; checking whether the control of the reading means is being executed or there is any control executing request; stopping the control of the reading means when the control of the reading means is not being executed and also there is no control executing request; renewing the toner residual amount information stored in the storage means mounted in the toner cartridge by the stored toner residual amount information when the control of the reading means is stopped; and releasing the stop of the control of the reading means when the toner residual amount information of the storage means is renewed.

According to another aspect of the present invention, there is provided an image forming method for an image forming device having reading means for reading an image of an original, and image forming means for supplying toner from a toner cartridge in which storage means for storing toner residual amount information is mounted, thereby forming an image, comprising: storing toner residual amount information of the toner cartridge when the control of forming an image by the image forming means is finished; checking whether toner is supplemented to the toner cartridge during image forming operation of the image forming means when the toner residual amount information of the toner cartridge is stored; checking whether the control of the reading means is being executed or there is any control executing request, and whether the processing of a communication function provided to the image forming device is being executed or there is any reception request; stopping the control of the reading means when the control of the reading means is not executed, there is no control executing request, the processing of the communication function is not executed and there is no reception request; renewing the toner residual amount information stored in the storage means mounted in the toner cartridge by the stored toner residual amount information; and releasing the stop of the control of the reading means when the toner residual amount information of the storage means is renewed.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate preferred embodiments of the invention, and together with the general description given above and the detailed description of the embodiments given below, serve to explain the principles of an aspect of the invention.

DETAILED DESCRIPTION OF THE INVENTION

An embodiment according to the present invention will be described.

Figure 1:
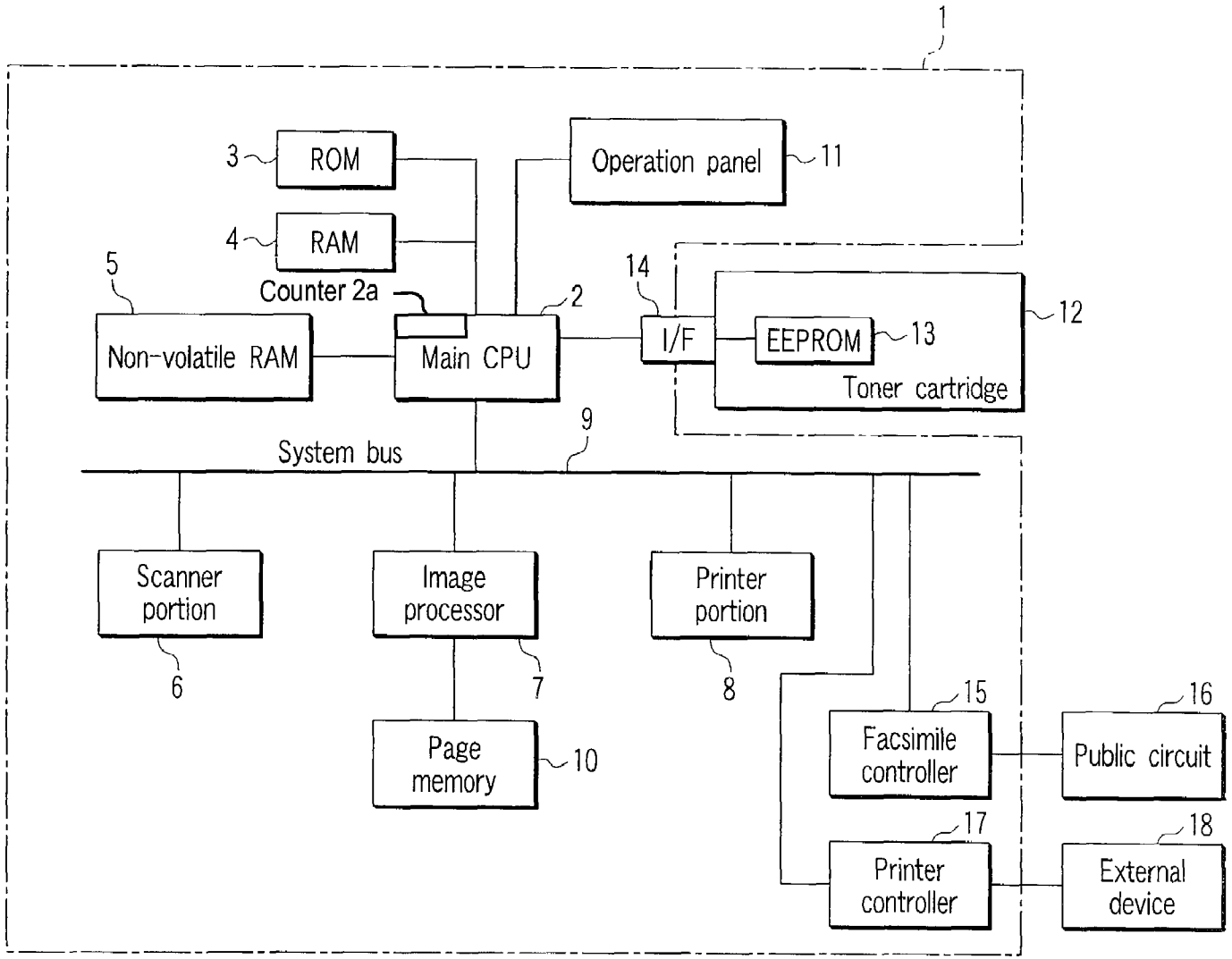
FIG. 1 is a block diagram showing the construction of a digital multi-function machine according to an image forming method of the present invention.

FIG. 1 shows the schematic construction of a digital multi-function machine (MFP: Multi Function Peripheral) 1 according to the image forming method of the present invention.

A main CPU 2 carries out the overall control of MFP 1, and is connected to ROM 3 for storing control programs, RAM 4 for temporarily storing data and non-volatile RAM 5 for holding storage data even when power is interrupted.

The main CPU 2 is connected to a scanner portion 6 for reading out an image of an original, an image processor 7 for executing the processing of the image and a printer portion 8 for forming the image, which are connected to one another through a system bus 9. A page memory 10 is connected to the image processor 7.

Furthermore, an operating panel 11 having a liquid crystal display portion (not shown) and various kinds of operating keys is connected to the main CPU 2.

A detachable toner cartridge 12 is mounted in MFP 1, and supplies toner used in the printer portion 8.

More specifically, the toner cartridge 12 has EEPROM 13 described later.

When the toner cartridge 12 is mounted in the machine body of MFP 1, EEPROM 13 is connected to the main CPU 2 through an interface (I/F) 14 provided to MFP 1.

Furthermore, the main CPU 2 is provided with a facsimile controller 15 and a printer controller 17 as MFP options.

The facsimile controller 15 is connected to a public circuit 16 and transmits/receives image data such as documents by using the facsimile function.

The printer controller 17 develops print data from an external device 18 such as a personal computer or the like to image data with the resolution corresponding to data indicating the resolution given to the print data.

When copying control (copying/printing job) is executed by MFP 1, the main CPU 2 counts a toner residual amount by a built-in counter 2*a* and stores it in the non-volatile RAM 5.

Figure 2:
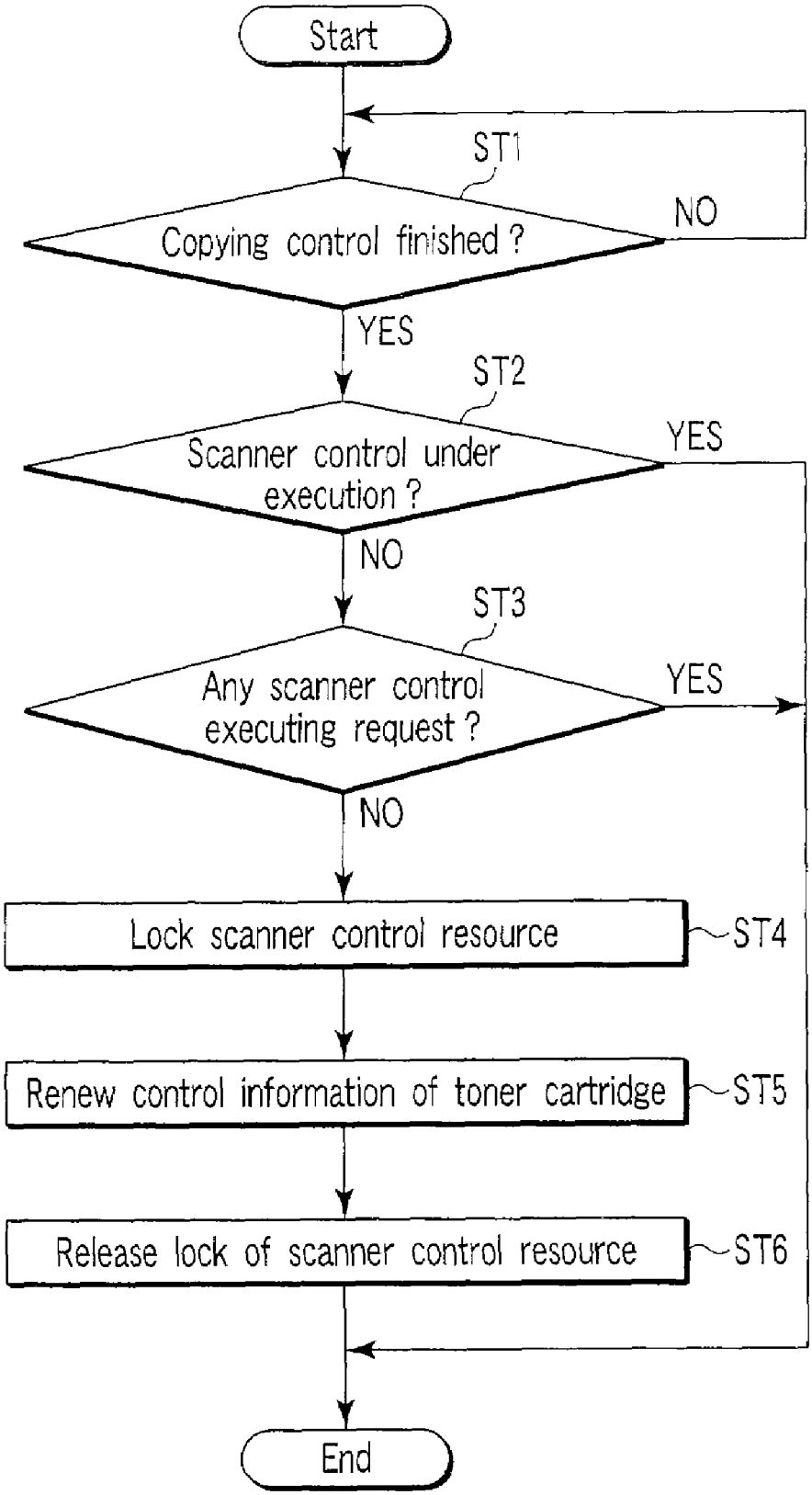
FIG. 2 is a flowchart showing the operation of a first embodiment.

Next, the operation according to the first embodiment of the present invention in the construction as described above will be described with reference to the flowchart of FIG. 2.

First, when the copying control (copying/printing job) is finished in MFP 1 (ST1), the main CPU 2 checks whether scanner control is being executed in the scanner portion 6 (ST2). The scanner control means the control for the driving of a motor (not shown) for driving the scanner portion 6 or the reading of the original by the scanner portion 6.

When the scanner control is not under execution in step ST2, the main CPU 2 checks whether there is any executing request of the scanner control from the operation panel 11 (ST3).

When there is no executing request for the scanner control in step ST3, the main CPU 2 locks a scanner control resource (ST4), reads out the count value of the toner residual amount stored in the non-volatile RAM 5, renews the control information (the count value of the toner residual amount) of EEPROM 13 of the toner cartridge 12 through I/F 14 (ST5), releases the lock of the scanner control resource (ST6) and finishes the copying operation.

When the scanner control is under execution in step ST2 or there is a scanner control executing request in step ST3, the main CPU 2 finishes the copying operation without renewing the control information of EEPROM 13 of the toner cartridge 12 through I/F 14.

That is, according to the first embodiment, the timing at which the counter value of the toner residual amount in EEPROM 13 of the toner cartridge 12 is renewed is set to the time at which the copying/printing job is finished. At that time, the main CPU 2 controls its operation so that another processing does not interrupt the operation of the main CPU 2 in order to prevent erroneous writing from the start time of the information renewal processing of EEPROM 13 till the end time of the information renewal processing.

When the control whose processing cannot be delayed because the processing load is large is started, the main CPU 2 does not execute the information renewal of EEPROM 13. For example, this control contains a reception operation from an external device 18 connected to the printer controller 17 of MFP 1, a reading operation of an original in the scanner portion 6, etc.

As described above, according to the first embodiment of the present invention, the timing of writing into EEPROM is set to the completion time of the copying/printing job, and thus the difference between the information owned by MFP and the information stored in EEPROM can be reduced.

Furthermore, erroneous data writing caused by the overlapping of the interface between highly urgent processing and EEPROM can be prevented.

Figure 3:
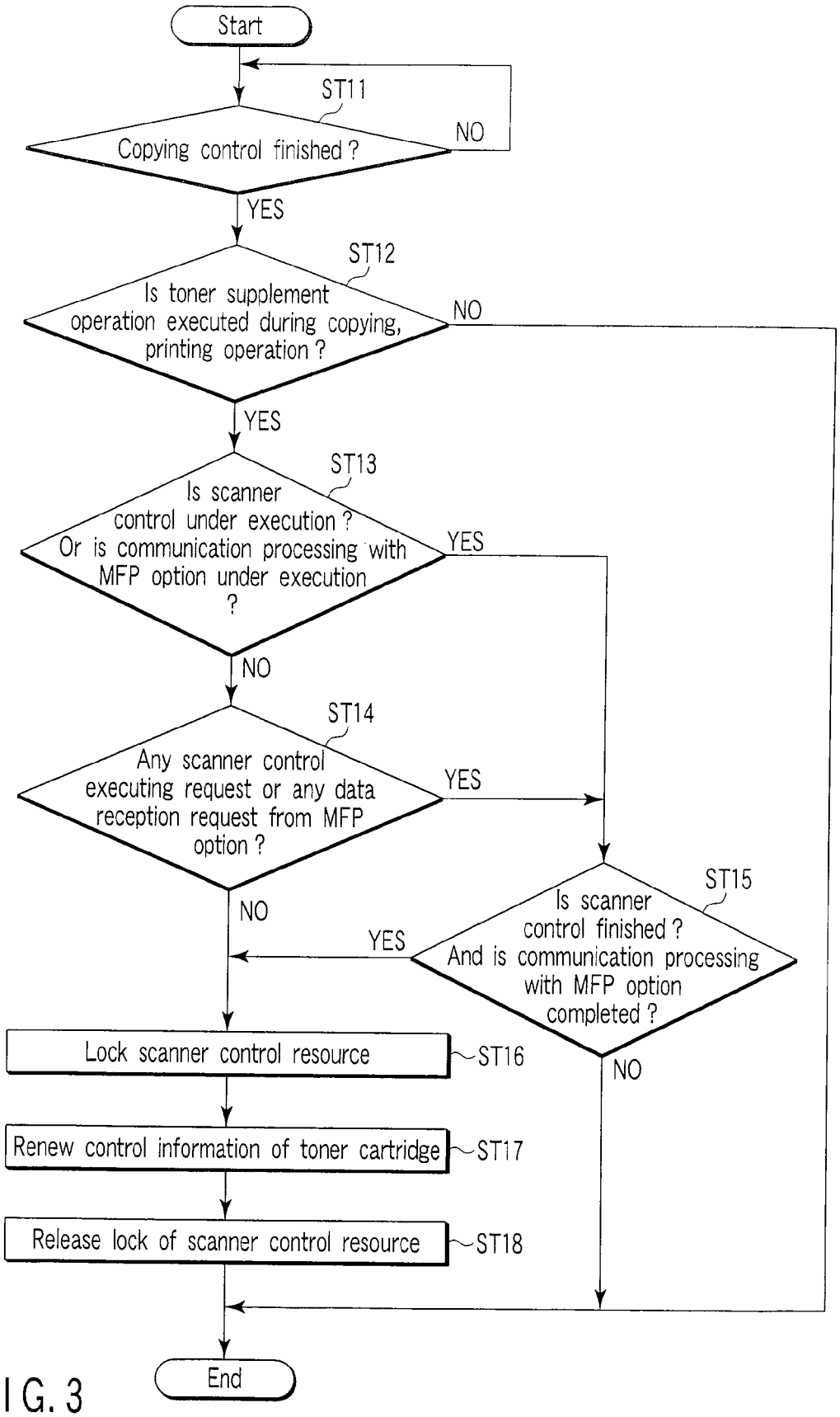
FIG. 3 is a flowchart showing the operation of a second embodiment.

Next, the operation according to a second embodiment of the present invention will be described with reference to the flowchart of FIG. 3.

First, when the copying control (copying/printing job) is finished in MFP 1 (ST11), the main CPU 2 checks whether the toner supplement operation is executed during the copying/printing operation in the scanner portion 6 (ST12).

When the toner supplement operation is executed during the copying/printing operation in step ST12, the main CPU 2 checks whether the scanner control is under execution or the communication processing with the MFP option is being executed (ST13). The MFP option means the communication processing with the facsimile controller 15 or the printer controller 17.

When the scanner control is not under execution and also the communication processing with the MFP option is not under execution in step ST13, the main CPU 2 checks whether there is any scanner control executing request or there is any data reception request from the MFP option (ST14).

Furthermore, when in step ST13 the scanner control is under execution or the communication processing with the MFP option is under execution, or when in step ST14 there is a scanner control execution request or a data reception request from the MFP option, the main CPU 2 checks whether the scanner control is finished or the communication processing with the MFP option is completed (ST15).

When in step ST14 there is neither scanner control execution request nor data reception request from the MFP option, or when in step ST15 the scanner control is finished and the communication processing with the MFP option is completed, the main CPU 2 locks the scanner control resource (ST16), reads out the count value of the toner residual amount stored in the non-volatile RAM 5, renews the control information (the counter value of the toner residual amount) of EEPROM 13 of the toner cartridge 12 through I/F 14 (ST17), releases the lock of the scanner control resource (ST18), and finishes the copying operation.

When in step ST12 the toner supplement operation is not executed during print operation, or when in step ST15 the scanner control is not finished and the communication processing with the MFP option is not completed, the main CPU 2 finishes the copying operation without renewing the control information of EEPROM 13 of the toner cartridge 12 through I/F 14.

As described above, according to the second embodiment, in addition to the condition and effect of the first embodiment described above, the information renewal to EEPROM 13 of the toner cartridge 12 is limited to a case where the toner supplement operation is executed during the printing job. That is, this is because it is unnecessary to renew information of EEPROM 13 when the toner supplement operation is not executed.

As described above, according to the second embodiment of the present invention, in addition to the effect of the first embodiment, it is unnecessary to carry out vain information renewal processing and thus reduce the erroneous data writing and processing time by narrowing the condition necessary for the renewal of information of EEPROM (whether the toner supplement operation is executed or not).

Additional advantages and modifications will readily occur to those skilled in the art. Therefore, the invention in its broader aspects is not limited to the specific details and representative embodiments shown and described herein.

Accordingly, various modifications may be made without departing from the sprit or scope of the general invention concept as defined by the appended claims and their equivalents.

What is claimed is:

1. An image forming method for an image forming device with printing data provided from a receiving device or a communication function, the method comprising:

storing toner amount information of a toner cartridge at a time when the power of the image forming device is turned on;

checking whether toner is supplemented from a toner cartridge to a printer member of the image forming device during an image forming operation of the image forming device; and renewing the toner amount information stored in a storage section of the toner cartridge while control of the processing of the communication function or control of receiving of the printing data provided from the receiving device is stopped.

2. The method of claim 1, wherein the storage section mounted in the toner cartridge is an EEPROM.

3. The method of claim 1, wherein the toner amount information of the toner cartridge is a count value achieved by counting a toner amount of use with the image forming.

4. The method of claim 1, wherein the communication function provided by the image forming device includes a facsimile communication function.

5. The method of claim 1, wherein the receiving device receives printing data from an external device.

6. The method of claim 1, wherein when no toner is supplemented, the toner amount information of the toner cartridge is not renewed.

7. The method of claim 3, wherein, when no toner is supplemented, the toner amount information of the toner cartridge is not renewed.

8. The method of claim 4, wherein, when no toner is supplemented, the toner amount information of the toner cartridge is not renewed.

9. The method of claim 5, wherein, when no toner is supplemented, the toner amount information of the toner cartridge is not renewed.

10. The method of claim 2, further comprising:

storing toner amount information to a storage unit within the image forming device comprises storing to the EEPROM.

11. An image forming apparatus comprising:

an image forming mechanism configured to form an image with printing data provided from a communication function or a receiving device;

a toner amount information storage configured to store toner amount information of a toner cartridge;

a used toner amount information counter configured to count used toner amount information with the image forming of the image forming mechanism;

a checker member configured to check if toner is supplemented during the image forming; and a toner amount information renew mechanism configured to renew the toner amount information stored in the toner amount information storage while control of the processing of the communication function or control of receiving of the printing data provided from the receiving device is stopped.

12. The apparatus of claim 11, wherein the toner amount information storage mounted in the toner cartridge is an EEPROM.

13. The apparatus of claim 11, wherein the used toner amount information of the toner cartridge is a count value achieved by counting a toner amount of use with the image forming.

14. The apparatus of claim 11, wherein the communication function provided by the image forming device includes a facsimile communication function.

15. The apparatus of claim 11, wherein the receiving device receives printing data from an external device.

16. The apparatus of claim 11, wherein the toner amount information renew mechanism renews the toner amount information of a toner cartridge using the used toner amount information.

17. The apparatus of claim 16, wherein the toner amount information renew mechanism includes the used toner amount information counter.

* * * * *